US006849990B2

(12) United States Patent
Li

(10) Patent No.: US 6,849,990 B2
(45) Date of Patent: Feb. 1, 2005

(54) SAFETY PIEZOELECTRIC LIGHTER

(76) Inventor: Kin Chung Li, 2211 S. Hacienda Blvd., Suite 107, Hacienda Heights, CA (US) 91745

( * ) Notice: Subject to any disclaimer, the term of this patent is extended or adjusted under 35 U.S.C. 154(b) by 207 days.

(21) Appl. No.: 10/336,362

(22) Filed: Jan. 6, 2003

(65) Prior Publication Data

US 2004/0130244 A1 Jul. 8, 2004

(51) Int. Cl.[7] ..... F23Q 3/01; H01L 41/113

(52) U.S. Cl. ..... 310/339; 431/255; 431/153; 361/260

(58) Field of Search ..... 431/132, 153, 431/255; 310/399; 361/261

(56) References Cited

U.S. PATENT DOCUMENTS 3,167,687 A * 1/1965 Buitkus ..... 431/132
6,443,727 B1 * 9/2002 Huang ..... 431/132
6,533,576 B1 * 3/2003 Sher ..... 431/255
6,682,341 B2 * 1/2004 Pan et al. ..... 431/153
6,733,277 B2 * 5/2004 Huang ..... 431/153
6,755,642 B2 * 6/2004 Zhang ..... 431/153

* cited by examiner

*Primary Examiner*—Thomas M. Dougherty
(74) *Attorney, Agent, or Firm*—Raymond Y. Chan; David and Raymond

(57) ABSTRACT

A safety arrangement, which is incorporated with a piezoelectric lighter, includes two axle holders, each having a blocking member, provided on two inner sides of the casing respectively, and an ignition cap including a pivot arm extended downwardly into an ignition cavity of casing and two pivot axles outwardly extended from two sides of the pivot arm into the axle holders respectively so as to pivotally and radially support the ignition cap on the casing wherein the blocking members normally bias against the pivot axles respectively to block up a downward movement of the ignition cap. When the ignition cap is radially slid, the pivot axles are rotatably moved to release the blocking up of the ignition cap with respect to the blocking members respectively, such that the ignition cap is capable of sliding downwardly to depress a piezoelectric unit so as to ignite the piezoelectric lighter.

20 Claims, 4 Drawing Sheets

SAFETY PIEZOELECTRIC LIGHTER

BACKGROUND OF THE PRESENT INVENTION

1. Field of Invention

The present invention relates to a lighter, and more particularly to a piezoelectric lighter incorporated with a safety arrangement which prevent the lighter from being ignited accidentally or undesirably.

2. Description of Related Arts

Piezoelectric lighters are widely used for prompted and accurate ignition. Conventional lighters are usually small, therefore, people often carry one or two of them around and use them to ignite a cigarette or cigar when necessary. They have become an essential tool for smokers.

A conventional piezoelectric lighter usually comprises a lighter case having a fuel storage cavity for storing liquefied gas and an ignition cavity, and an ignition system. The ignition system usually comprises a gas releasing valve communicated with the fuel storage cavity, a gas emitting nozzle extended from the gas releasing valve wherein when the gas releasing valve is lifted up, the liquefied fuel will be released through the gas emitting nozzle, a piezoelectric unit which comprises a main piezoelectric body disposed in the ignition cavity and a movable operating part movably extended from the main piezoelectric body, wherein when the movable operating part is depressed towards the main piezoelectric body, a spark is generated at the spark generating tip extended from the main piezoelectric body. The ignition system further comprises a lighter trigger movably disposed in the lighter case, and operatively communicated with the movable operating part of the piezoelectric unit and the gas releasing valve via a gas lever in such a manner that the lighter trigger is adapted to move between a normal position and an ignition position, wherein in the ignition position, the lighter trigger is moved to depress the movable operating part of the piezoelectric unit and, at the same time, uplift the gas releasing valve so as to release the liquefied fuel via the gas emitting nozzle. The gas emitting nozzle is extended to a position adjacent to the spark generating tip so that the liquefied fuel coming out from the has emitting nozzle can be ignited by the spark generated at the spark generating tip when the lighter trigger is in the ignition position. On the hand, when the lighter trigger is in the normal position, the ignition trigger is moved in such a manner that the depressing force of the movable operating part of the piezoelectric unit is relieved and the gas releasing valve is restored to its original position for blocking further release of the liquefied fuel stored in the fuel storing cavity.

For years, several kinds of piezoelectric lighters have been developed for several purposes. In terms of ignition mechanism, piezoelectric lighters can be broadly divided into depression type and sliding type. The difference of which is mainly lied on the type of movement of the ignition trigger. Nevertheless, they both possess a potential problem: they all vulnerable to undesirable or accidental ignition.

Conventional piezoelectric lighters do not have any safety arrangement to prevent the lighter from being accidentally or undesirably ignited. As result, children can, driven by curiosity, easily ignite the lighter without adult's notice. One can easily recognize that this can result in a very serious or even disastrous situation.

Because of the above-mentioned reasons, some sorts of safety piezoelectric lighters have been developed wherein safety mechanisms are incorporated with the lighters in order to prevent accidental or undesirable ignitions, especially performed by children. However, those safety most of the safety mechanisms are either so simple to operate even children can unlock the lighter trigger or so inconvenient that the safety mechanisms themselves make the lighters very difficult to operate. In the former cases, the safety mechanisms are virtually meaningless, while in the later cases, the safety mechanism directly and severely affect the performance of the piezoelectric lighters to destroy the very advantages of a lighter—provision of rapid, accurate and convenient ignition virtually in everywhere.

Moreover, even though the above-mentioned safety lighters are appropriately designed and manufactured such that better safety effect is achieved, however, because such kinds of lighters have been extensively sold for years, lots of people, including children, have been already familiar with the safety mechanisms and operations for these piezoelectric lighters. As a result, their safety effects are virtually diluted.

Thus, convenient and safety in the context of piezoelectric lighters always have contradiction. The degree to which convenience is 'traded' with safety is of overriding interest to both manufacturers as well as end users of the piezoelectric lighters. However, optimal safety piezoelectric light has not yet been invented.

Yet in conjunction with the forgoing elaboration of the usual operation of conventional safety lighters, one further disadvantage which is not obvious to people is that such kind of conventional safety lighter require the user to intentionally unlock the safety device before igniting the lighter. However, this possesses considerable inconvenience to the users.

SUMMARY OF THE PRESENT INVENTION

A main object of the present invention is to provide a piezoelectric lighter incorporated with a safety arrangement which is capable of preventing the lighter from being accidentally or undesirably ignited.

Another object of the present invention is to provide a piezoelectric lighter incorporated with a safety arrangement wherein two consecutive actions of different nature—namely sliding and depressing are required to ignite the lighter such that the safety arrangement is simple enough to operate and at the same time, is safe enough to prevent accidental or undesirable ignition. In other words, the present invention combines the sliding type and the depressing type piezoelectric lighter to form a safety piezoelectric lighter.

Another object of the present invention is to provide a piezoelectric lighter incorporated with a safety arrangement which normally and automatically locks up the lighter when it is not in use.

Another object of the present invention is to provide a piezoelectric lighter comprising a sliding safety arrangement which neither involves expensive or complicated mechanical components nor alters the original structure of the piezoelectric lighter, so as to minimize the manufacturing and other product development cost of the present invention.

Another object of the present invention is to provide a piezoelectric lighter incorporated with a safety arrangement which does not require the user to intentionally unlock the safety arrangement but unobvious to igniting the lighter of the present invention.

Accordingly, in order to accomplish the above objects, the present invention provides a piezoelectric lighter, comprising:

a casing receiving a fuel storage cavity and having an ignition cavity provided therein;

an ignition system which comprises:

a gas emitting nozzle communicated with the fuel storage cavity for controlling a flow of gas; and a piezoelectric unit, which is disposed in the ignition cavity, comprising a movable operating part extending upwardly, and a spark generating tip extended to a position adjacent to the gas emitting nozzle, wherein when the movable operating part is depressed to a predetermined ignition level, the spark generating tip generates sparks to ignite the gas emitted from the gas emitting nozzle; and a safety arrangement, which comprises:

two axle holders provided on two inner sides of the casing respectively, wherein each of the axle holders comprises a blocking member provided thereon; and an ignition cap which comprises a pivot arm extended downwardly into the ignition cavity, and two pivot axles outwardly extended from two sides of the pivot arm into the axle holders respectively so as to pivotally and radially support the ignition cap on the casing, the blocking members being normally biased against the pivot axles respectively to block up a downward movement of the ignition cap, wherein when the ignition cap is radially slid on the casing, the pivot axles are rotatably moved to release the blocking up of the ignition cap with respect to the blocking members of the axle holders respectively, such that the ignition cap is capable of sliding downwardly to depress the movable operating part of the piezoelectric unit.

DETAILED DESCRIPTION OF THE PREFERRED EMBODIMENT

Figure 1:
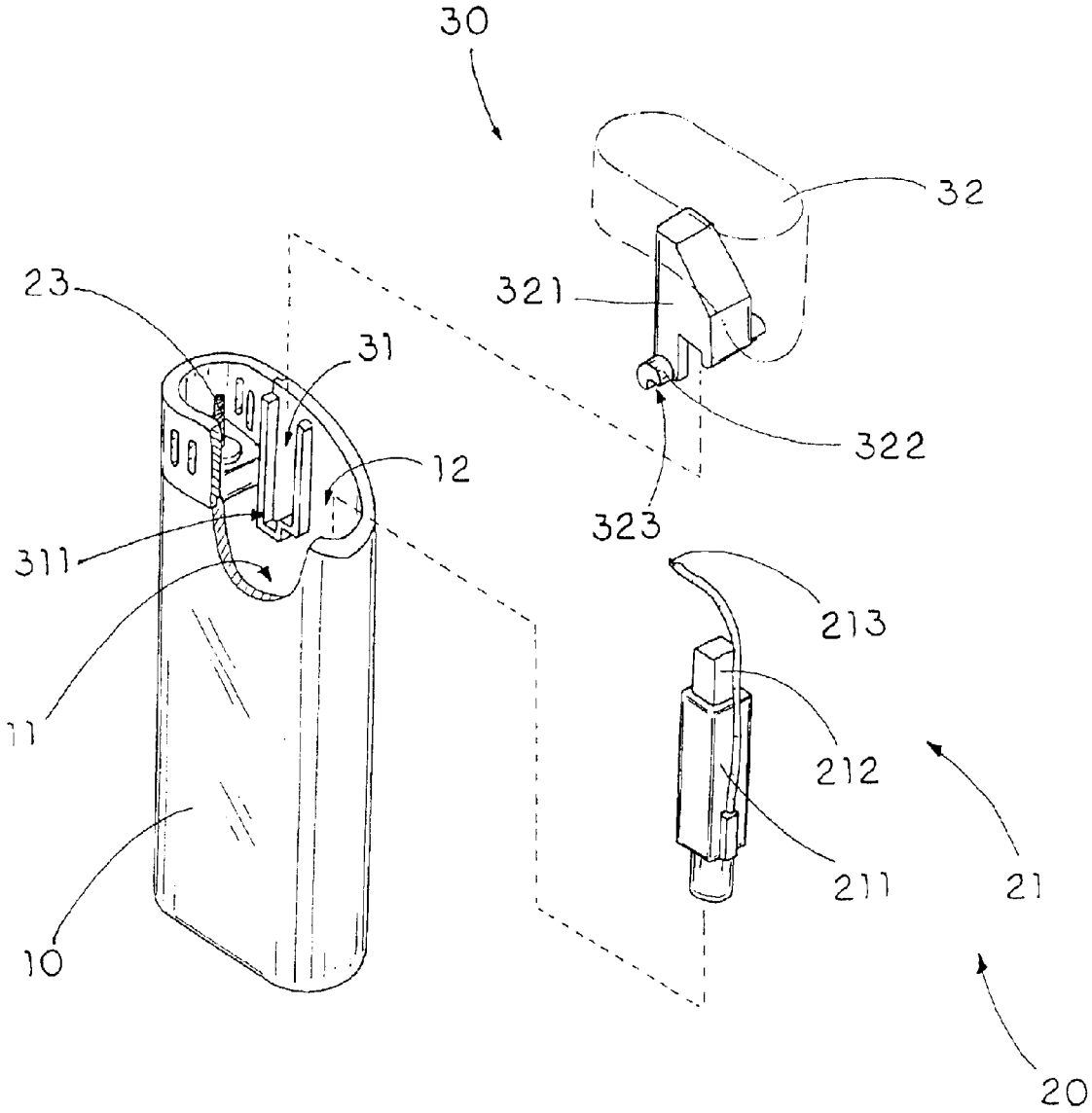
FIG. 1 is an exploded perspective view of a piezoelectric lighter incorporated with a safety arrangement according to a preferred embodiment of the present invention.
Figure 2:
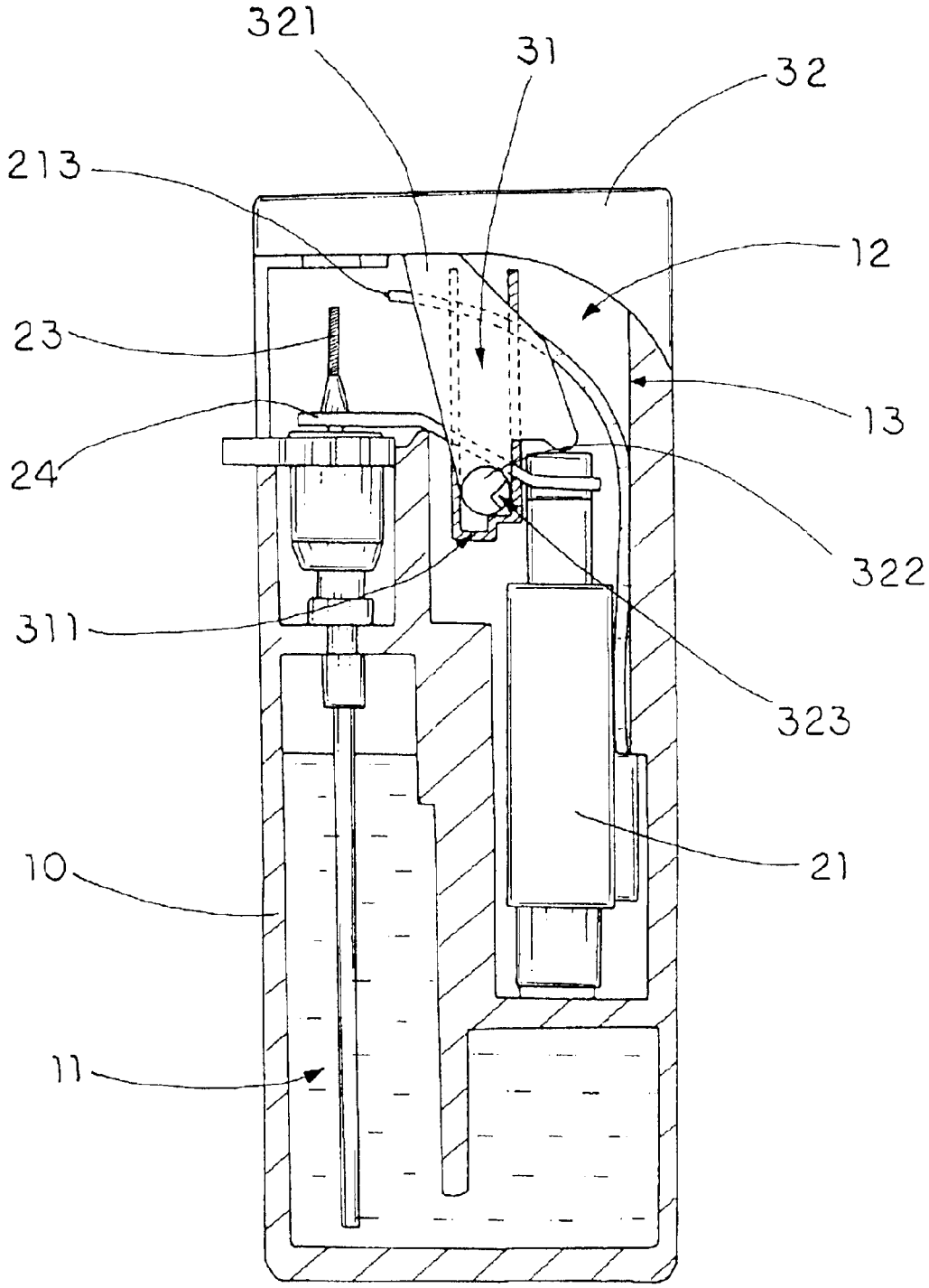
FIG. 2 is a sectional side view of the piezoelectric lighter in a normal safety position according to the above preferred embodiment of the present invention.

Referring to FIGS. 1 and 2 of the drawings, a piezoelectric lighter 1 according to a first preferred embodiment of the present invention is illustrated, wherein the piezoelectric lighter 1 comprises a casing 10 receiving a fuel storage cavity 11 and having an ignition cavity 12 provided therein, an ignition system 20, and a piezoelectric safety arrangement 30.

The ignition system 20 comprises a gas emitting nozzle 23 and a piezoelectric unit 21. The gas emitting nozzle 22 is communicated with the fuel storage cavity 11 via a gas releasable valve 22 for controlling a flow of gas, wherein the gas releasable valve 22 is adapted to be lifted up for releasing the gas in the fuel storage cavity 11 through the gas emitting nozzle 23.

The piezoelectric unit 21, which is disposed in the ignition cavity 11, comprises a main piezoelectric body 211, a movable operating part 212 upwardly extended therefrom, and a spark generating tip 213 extended to a position adjacent to the gas emitting nozzle 23, wherein when the movable operating part 212 is depressed to a predetermined ignition level, the spark generating tip 213 generates sparks to ignite the gas emitted from the gas emitting nozzle 23.

Accordingly, the ignition system 20 further comprises a gas lever 24, which is pivotally supported in the ignition cavity 12, has an uplifting end connected to the gas releasable valve 22 and a depressing end arranged in such a manner that when the ignition cap 32 is depressed downwardly to depress the depressing end of the gas lever 24, the uplifting end of the gas lever 24 pivotally lifts up the gas releasable valve 22 to release the gas from the fuel storage cavity 11.

The safety arrangement 30 comprises two axle holders 31 provided on two opposed inner sides of the casing 10 respectively wherein each of the axle holders 31 comprises a blocking member 311 provided thereon, and an ignition cap 32 which comprises a pivot arm 321 extended downwardly into the ignition cavity 12 and two pivot axles 322 outwardly extended from two sides of the pivot arm 321 into the axle holders 31 respectively so as to pivotally and radially support the ignition cap 32 on the casing 10.

Figure 3:
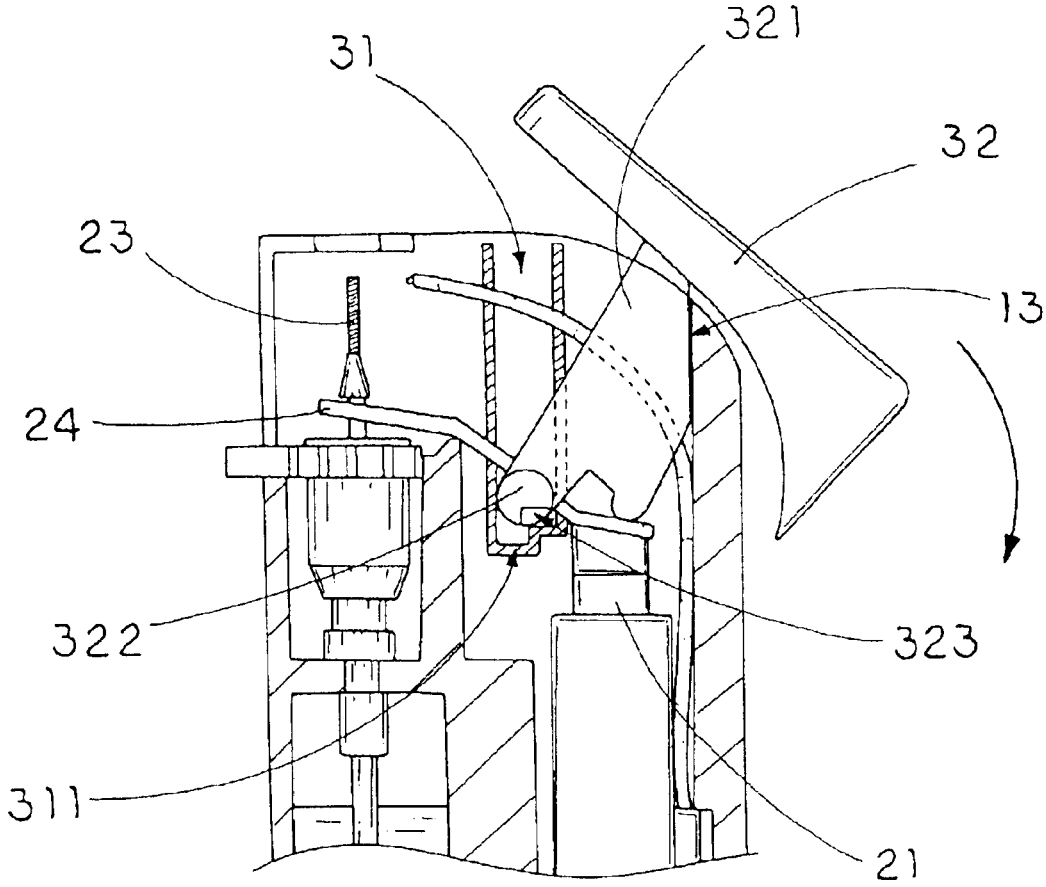
FIG. 3 is a schematic diagram of the ignition cap of the piezoelectric lighter according to the above preferred embodiment of the present invention, illustrating that the ignition cap in the ignition position.

The blocking members 311 are normally biased against the pivot axles 322 respectively to block up a downward movement of the ignition cap 32, wherein when the ignition cap 32 is radially slid on the casing 10, the pivot axles 322 are rotatably moved to release the blocking up of the ignition cap 32 with respect to the blocking members 311 of the axle holders 31 respectively, such that the ignition cap 32 is capable of sliding downwardly to depress the movable operating part 212 of the piezoelectric unit 21, as shown in FIG. 3.

According to the first preferred embodiment, each of the axle holders 31 has an elongated slot extended from a top edge of a sidewall of the casing 10 into the ignition cavity 12 of the casing 10 in such a manner that each of the pivot axles 322 is guided to slide into the respective elongated slot in a rotatably movable manner, wherein the blocking members 311 are formed at bottom portions of the elongated slots of the axle holders 31 respectively.

The pivot axles 322 are integrally and opposedly extended from a bottom portion of the pivot arm 321 in such a manner that the ignition cap 32 is arranged to support on the casing 10 while the pivot arm 321 is extended into the ignition cavity 12 and the pivot axles 322 are received in the axle holders 31 respectively.

Each of the pivot axles 322 has an engaging groove 323 indented on a circumferential surface thereof, wherein the ignition cap 32 is capable of moving between a normal position and an ignition position, wherein at the normal position, the blocking members 311 of the axle holders 31 are arranged to bias against the circumferential surfaces of the pivot axles 322 to block up a downward movement of the ignition cap 32. At the ignition position, the ignition cap 32 is radially and rearwardly slid with respect to the casing 10, the engaging grooves 323 of the pivot axles 322 are substantially aligned with the blocking members 311 of the axle holders 31 respectively such that the ignition cap 32 is capable of moving downwardly to depress the piezoelectric unit 21 while the blocking members 311 are received in the engaging grooves 323 respectively.

In other words, at its normal position, the ignition cap 32 is pivotally supported on the casing 10 about the pivot axles 322 in such a manner that any downward movement, especially those caused by depression of the ignition cap 32, will be blocked by the blocking members 311 of the axle holders 31. Therefore, initially, the ignition cap 32 is only allowed to have a pivotal movement with respect to the casing 10.

According to the preferred embodiment, each of the blocking members 311 is protruded from the respective axle holder 31 and is shaped and sized to fittingly receive in the engaging groove 323 of the respective pivot axle 322. Moreover, a height of each of the engaging grooves 323 is at least larger than a distance of the ignition cap 32 downwardly traveling to depress the piezoelectric unit 21 at the ignition level in such a manner that when the engaging grooves 323 of the pivot axles 322 are aligned with the blocking members 311 of the axle holders 31 respectively, the ignition cap 32 is capable of being depressed to compress the piezoelectric unit 21 at the ignition level, as shown in FIG. 3.

Accordingly, the height of each of the engaging grooves 323 should be in the range of 1 mm–2 mm such that the adult does not need to depress the ignition cap 32 deeply into the casing 10 but is yet effective enough to provide a safety measure against accidental and undesirable ignition. In other words, the difference between the ignition level and the level at which the movable operating part 212 of the piezoelectric unit 21 is compressed by the radial movement of the ignition cap 32 should be lie in the range of 1 mm–2 mm as well in order to ensure the generation of a spark at the spark generating tip 213.

As shown in FIGS. 1 and 2, the casing 10 further has a stopping surface 13 provided on a rear wall of the casing 10 wherein the stopping surface 13 of the casing 10 is arranged in such a manner that when the ignition cap 32 is radially and rearwardly slid on the casing 10, the ignition cap 32 is stopped and biased against the stopping surface 13 of the casing 10 while the engaging grooves 323 of the pivot axles 322 are substantially aligned with the blocking members 311 of the axle holders 31 respectively.

Figure 4:
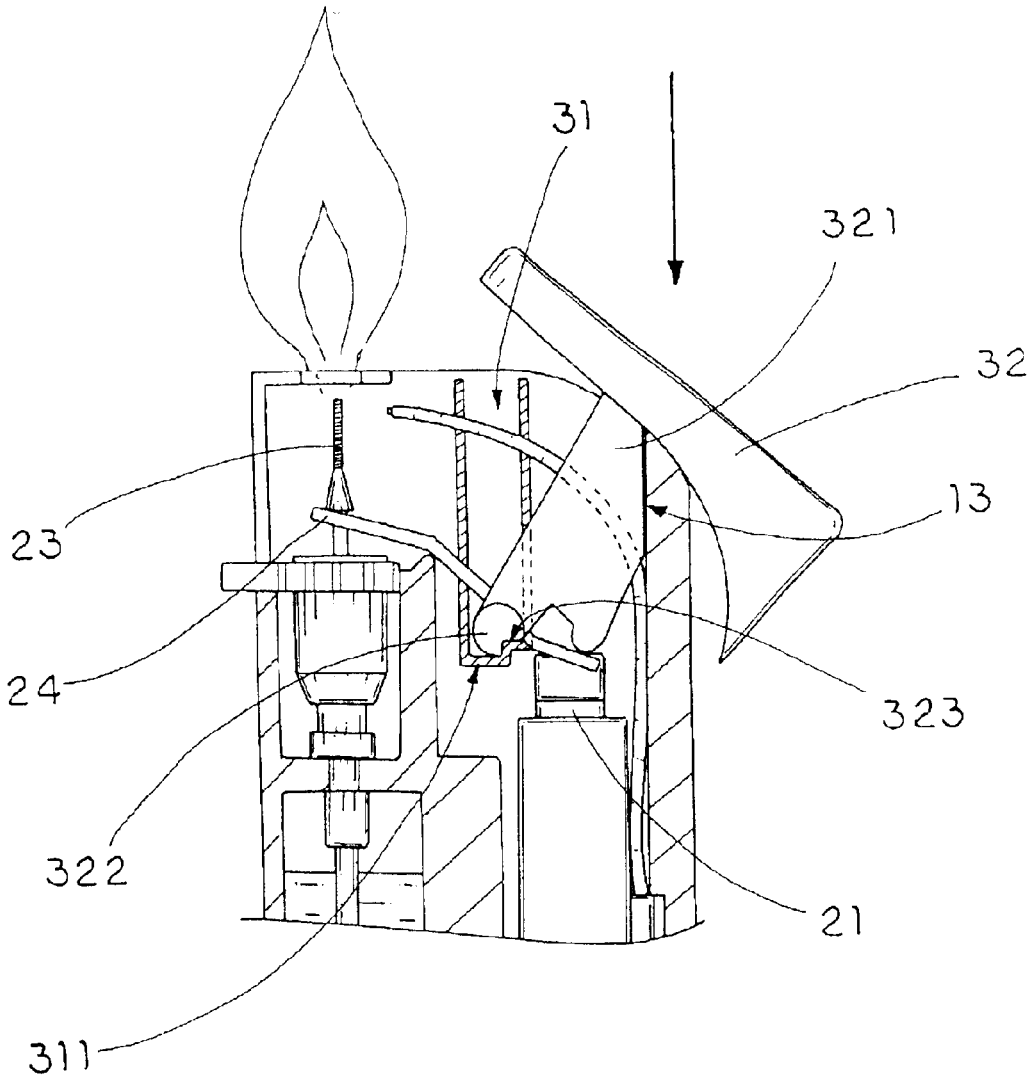
FIG. 4 is a schematic diagram of the ignition cap of the piezoelectric lighter according to the above preferred embodiment of the present invention, illustrating that the ignition cap being depressed to ignite the piezoelectric lighter.

In other words, once the pivotal movement of the ignition cap 32 is stopped by the stopping surface 13 of the casing 10, the ignition cap 32 is capable of depressing downward to compress the piezoelectric unit 21 so as to ignite the piezoelectric lighter 1 of the present invention. Accordingly, the stopping surface 13 is vertically formed on the rear wall of the casing 10 such that when the ignition cap 32 is biased against the stopping surface 13 of the casing 10, the ignition cap 32 is allowed to vertically depress to slide along the stopping surface 13, so as to compress the piezoelectric unit 21 to the ignition level thereof, as shown in FIG. 4.

Therefore, the stopping surface 13 of the casing 10 functions not only as a blocking wall to prevent the ignition cap 32 sliding out of the casing 10 but also as a guiding means to guide the engaging grooves 323 of the pivot axles 322 aligning with the blocking members 311 of the axle holders 31 respectively.

Since the pivot axles 322 are blocked by the blocking members 311 within the axle holders 31 respectively, there is no vertical movement is performed when the ignition cap 32 is pivotally slid from the normal position to a position that the ignition cap 32 is biased against the stopping surface 13 of the casing 10. Therefore, the piezoelectric lighter 1 of the present invention cannot be ignited as the piezoelectric unit 21 is not compressed to the ignition level.

According to the preferred embodiment, the ignition cap 32 further comprises a piezo-depressor 324 extending downwardly to rest on the movable operating part 212 of the piezoelectric unit 21 to partially depress the movable operating part 212 of the piezoelectric unit 21 when the ignition cap 32 is radially and rearwardly slid on the casing 10. Specifically, when the ignition cap 32 is in the normal position, the piezo-depressor 324 is positioned right above the movable operating part 212 of the piezoelectric unit 21. However, when the ignition cap 32 is radially slid, the piezo-depressor 324 is pivotally moved to depress the movable operating part 212 to an extent above the predetermined ignition level of the piezoelectric unit 21. In other words, at such depressing position of the piezoelectric unit 21, the piezoelectric lighter 1 of the present invention is not yet ignited.

It is worth stressing that when the ignition cap 32 is radially slid on the casing 10, the movable operating part 212 of the piezoelectric unit 21 is depressed much towards the predetermined ignition level thereof but not yet actually reach the predetermined ignition level, as a result, slight further depression of the ignition cap 32 is required to drive the piezo-depressor 324 to depress the movable operating part 212 to the predetermined ignition level so as to trigger a spark at the spark generating tip 213.

In order to ignite the piezoelectric lighter 1 in accordance with the preferred embodiment of the present invention, the adult must rearwardly slide the ignition cap 32 until the ignition cap 32 biases against the stopping surface 13 of the casing 10. At that time, the pivot axles 322 are driven to be rotated through the pivot arm 321 such that the engaging grooves 323 of the pivot axles 322 are substantially align with the blocking members 311 of the axle holders 31 respectively. Also, the movable operating part 212 is depressed by the piezo-depressor 324 at a level slightly less than the predetermined ignition level.

Then, the adult has to depress the ignition cap 32 in order to depress the movable operating part 212 of the piezoelectric unit 21 to reach the predetermined ignition level. Since the ignition cap 32 at this time has already been in the ignition position, no structural hurdle will block the depressing movement of the ignition cap 32 until top ends of the blocking members 311 reach the top ceilings of the engaging grooves 323 respectively.

Once the ignition cap 32 is depressed, the movable operating part 212 of the piezoelectric unit 21 reaches its predetermined ignition level so that the spark is generated at the spark generating tip 213, the gas releasing valve 22 will be uplifted to release liquefied fuel through the gas emitting nozzle 23. Finally, the gas coming out from the gas emitting nozzle 23 will be ignited by the spark generating tip 213.

After the piezoelectric lighter 1 is ignited, the movable operating part 212 of the piezoelectric unit 21 will automatically rebounds to its original position, and therefore, the ignition cap 32 will be automatically pulled upward until the blocking members 311 are moved out of the engaging grooves 323 respectively. Then, the upward pushing force of the piezoelectric unit 21 will push the ignition cap 32 radially sliding back to the original position.

From the forgoing analysis, one can easily see that by sliding the ignition cap 32 radially and rearwardly with respect to the casing 10, the piezoelectric lighter 1 of the present invention cannot be ignited. Only the adult depresses the ignition cap 32 after the radial movement thereof can compress the piezoelectric unit 21 to the ignition level so as to ignite the piezoelectric lighter 1. In other words, two consecutive actions are required to ignite the piezoelectric lighter 1. Since conventional slide-type piezoelectric lighters do not need depression of the ignition cap 32, the present invention provides unexpected ignition procedures to prevent accidental or undesirable ignition, especially those performed by children.

What is claimed is:

1. A piezoelectric lighter, comprising:

a casing receiving a fuel storage cavity and having an ignition cavity provided therein;

an ignition system which comprises:

a gas emitting nozzle communicated with said fuel storage cavity for controlling a flow of gas; and a piezoelectric unit which is disposed in said ignition cavity, comprising a movable operating part extending upwardly, and a spark generating tip extended to a position adjacent to said gas emitting nozzle, wherein when said movable operating part is depressed to a predetermined ignition level, said spark generating tip generates sparks to ignite said gas emitted from said gas emitting nozzle; and a safety arrangement, which comprises:

two axle holders provided on two opposed inner sides of said casing respectively, wherein each of said axle holders comprises a blocking member provided thereon; and an ignition cap which comprises a pivot arm extended downwardly into said ignition cavity, and two pivot axles outwardly extended from two sides of said pivot arm into said axle holders respectively so as to pivotally support said ignition cap on said casing in a radially movable manner, said blocking members being normally biased against said pivot axles respectively to block up a downward movement of said ignition cap, wherein when said ignition cap is radially slid on said casing, said pivot axles are rotatably moved to release a blocking up of said ignition cap with respect to said blocking members of said axle holders respectively, such that said ignition cap is capable of sliding downwardly to depress said movable operating part of said piezoelectric unit so as to ignite said piezoelectric lighter.

2. A piezoelectric lighter, as recited in claim 1, wherein each of said pivot axles has an engaging groove indented on a circumferential surface thereof, wherein said ignition cap is capable of moving between a normal position and an ignition position, wherein at said normal position, said blocking members of said axle holders are arranged to bias against said circumferential surfaces of said pivot axles to block up said downward movement of said ignition cap, and at said ignition position, said ignition cap is radially and rearwardly slid with respect to said casing, said engaging grooves of said pivot axles are substantially aligned with said blocking members of said axle holders respectively such that said ignition cap is capable of moving downwardly to depress said piezoelectric unit while said blocking members are received in said engaging grooves respectively.

3. A piezoelectric lighter, as recited in claim 2, wherein a height of each of said engaging grooves being at least larger than a distance of said ignition cap downwardly traveling to compress said piezoelectric unit at said ignition level in such a manner that when said engaging grooves of said pivot axles are aligned with said blocking members of said axle holders respectively, said ignition cap is capable of being depressed to compress said piezoelectric unit at said ignition level, so as to ignite said piezoelectric lighter.

4. A piezoelectric lighter, as recited in claim 1, wherein each of said axle holders has an elongated slot extended from a top edge of a sidewall of said casing into said ignition cavity of said casing in such a manner that said pivot axles are guided to slide into said elongated slots in a rotatably movable manner.

5. A piezoelectric lighter, as recited in claim 3, wherein each of said axle holders has an elongated slot extended from a top edge of a sidewall of said casing into said ignition cavity of said casing in such a manner that said pivot axles are guided to slide into said elongated slots in a rotatably movable manner.

6. A piezoelectric lighter, as recited in claim 2, wherein each of said blocking members is protruded from a bottom portion of said respective axle holder and is shaped and sized to fittingly receive in said engaging groove of said respective pivot axle when said pivot axle is rotated to align said engaging groove with said blocking member.

7. A piezoelectric lighter, as recited in claim 4, wherein each of said blocking members is protruded from a bottom portion of said respective axle holder and is shaped and sized to fittingly receive in said engaging groove of said respective pivot axle when said pivot axle is rotated to align said engaging groove with said blocking member.

8. A piezoelectric lighter, as recited in claim 5, wherein each of said blocking members is protruded from a bottom portion of said respective axle holder and is shaped and sized to fittingly receive in said engaging groove of said respective pivot axle when said pivot axle is rotated to align said engaging groove with said blocking member.

9. A piezoelectric lighter, as recited in claim 1, wherein said casing further has a stopping surface provided on a rear wall thereof, wherein said stopping surface of said casing is arranged in such a manner that when said ignition cap is radially and rearwardly slid on said casing, said ignition cap is stopped and biased against said stopping surface of said casing while said pivot axles are rotatably moved to release said blocking up of said ignition cap with respect to said blocking members.

10. A piezoelectric lighter, as recited in claim 3, wherein said casing further has a stopping surface provided on a rear wall thereof, wherein said stopping surface of said casing is arranged in such a manner that when said ignition cap is radially and rearwardly slid on said casing, said ignition cap is stopped and biased against said stopping surface of said casing while said pivot axles are rotatably moved to release said blocking up of said ignition cap with respect to said blocking members.

11. A piezoelectric lighter, as recited in claim 5, wherein said casing further has a stopping surface provided on a rear wall thereof, wherein said stopping surface of said casing is arranged in such a manner that when said ignition cap is radially and rearwardly slid on said casing, said ignition cap is stopped and biased against said stopping surface of said casing while said pivot axles are rotatably moved to release said blocking up of said ignition cap with respect to said blocking members.

12. A piezoelectric lighter, as recited in claim 8, wherein said casing further has a stopping surface provided on a rear wall thereof, wherein said stopping surface of said casing is arranged in such a manner that when said ignition cap is radially and rearwardly slid on said casing, said ignition cap is stopped and biased against said stopping surface of said casing while said pivot axles are rotatably moved to release said blocking up of said ignition cap with respect to said blocking members.

13. A piezoelectric lighter, as recited in claim 9, wherein said stopping surface is vertically formed on said rear wall of said casing such that when said ignition cap is biased against said stopping surface of said casing, said ignition cap is allowed to vertically depress to slid along said stopping surface so as to compress said piezoelectric unit to said ignition level thereof.

14. A piezoelectric lighter, as recited in claim 10, wherein said stopping surface is vertically formed on said rear wall of said casing such that when said ignition cap is biased against said stopping surface of said casing, said ignition cap is allowed to vertically depress to slid along said stopping surface so as to compress said piezoelectric unit to said ignition level thereof.

15. A piezoelectric lighter, as recited in claim 11, wherein said stopping surface is vertically formed on said rear wall of said casing such that when said ignition cap is biased against said stopping surface of said casing, said ignition cap is allowed to vertically depress to slid along said stopping surface so as to compress said piezoelectric unit to said ignition level thereof.

16. A piezoelectric lighter, as recited in claim 12, wherein said stopping surface is vertically formed on said rear wall of said casing such that when said ignition cap is biased against said stopping surface of said casing, said ignition cap is allowed to vertically depress to slid along said stopping surface so as to compress said piezoelectric unit to said ignition level thereof.

17. A piezoelectric lighter, as recited in claim 1, wherein said ignition cap further comprises a piezo-depressor extending downwardly to rest on said movable operating part of said piezoelectric unit to partially depress said movable operating part of said piezoelectric unit when said ignition cap is radially and rearwardly slid on said casing.

18. A piezoelectric lighter, as recited in claim 5, wherein said ignition cap further comprises a piezo-depressor extending downwardly to rest on said movable operating part of said piezoelectric unit to partially depress said movable operating part of said piezoelectric unit when said ignition cap is radially and rearwardly slid on said casing.

19. A piezoelectric lighter, as recited in claim 8, wherein said ignition cap further comprises a piezo-depressor extending downwardly to rest on said movable operating part of said piezoelectric unit to partially depress said movable operating part of said piezoelectric unit when said ignition cap is radially and rearwardly slid on said casing.

20. A piezoelectric lighter, as recited in claim 12, wherein said ignition cap further comprises a piezo-depressor extending downwardly to rest on said movable operating part of said piezoelectric unit to partially depress said movable operating part of said piezoelectric unit when said ignition cap is radially and rearwardly slid on said casing.

* * * * *